US010422588B2

(12) United States Patent
Smith et al.

(10) Patent No.: US 10,422,588 B2
(45) Date of Patent: Sep. 24, 2019

(54) HEAT EXCHANGER COIL WITH OFFSET FINS

(71) Applicant: TRANE INTERNATIONAL INC., Davidson, NC (US)

(72) Inventors: Sean A. Smith, Chapmansboro, TN (US); Michael W. Groen, La Crosse, WI (US); William B. Fox, Onalaska, WI (US); Brian Westfall, Elgin, SC (US); Felix Quintero, Columbia, SC (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/505,000

(22) PCT Filed: Aug. 21, 2015

(86) PCT No.: PCT/US2015/046298
§ 371 (c)(1),
(2) Date: Feb. 17, 2017

(87) PCT Pub. No.: WO2016/029115
PCT Pub. Date: Feb. 25, 2016

(65) Prior Publication Data

US 2017/0284749 A1 Oct. 5, 2017

Related U.S. Application Data

(60) Provisional application No. 62/040,155, filed on Aug. 21, 2014.

(51) Int. Cl.
*F28F 1/22* (2006.01)
*F28F 3/02* (2006.01)
(Continued)

(52) U.S. Cl.
CPC ..... *F28F 1/22* (2013.01); *F25B 39/00* (2013.01); *F28D 1/05383* (2013.01);
(Continued)

(58) Field of Classification Search
CPC .. F28F 1/22; F28F 1/126; F28F 19/006; F28F 19/02; F28F 2260/02; F28F 1/10;
(Continued)

(56) References Cited

U.S. PATENT DOCUMENTS 3,768,149 A 10/1973 Swaney, Jr.
4,096,616 A 6/1978 Coffinberry
(Continued)

OTHER PUBLICATIONS

International Search Report and Written Opinion, International Patent Application No. PCT/US2015/046298, dated Nov. 30, 2015 (11 pages).

*Primary Examiner* — Justin M Jonaitis
(74) *Attorney, Agent, or Firm* — Hamre, Schumann, Mueller & Larson, P.C.

(57) ABSTRACT

Apparatuses, systems and methods are directed to heat exchangers that are made of microchannel tubes and that have offset fins of various geometries and density. The heat exchanger coils can be implemented in various refrigeration and/or heating, ventilation, and air conditioning (HVAC) units or systems thereof.

20 Claims, 5 Drawing Sheets

(51) Int. Cl.

| | |
|---|---|
| ***F28F 13/02*** | (2006.01) |
| ***F28F 19/00*** | (2006.01) |
| ***F28D 1/053*** | (2006.01) |
| ***F28F 1/12*** | (2006.01) |
| ***F25B 39/00*** | (2006.01) |
| ***F28F 19/02*** | (2006.01) |
| ***F28B 1/06*** | (2006.01) |
| ***F28D 21/00*** | (2006.01) |

(52) U.S. Cl.
CPC ..... *F28F 1/126* (2013.01); *F28F 1/128* (2013.01); *F28F 3/027* (2013.01); *F28F 13/02* (2013.01); *F28F 19/006* (2013.01); *F28F 19/02* (2013.01); *F28B 1/06* (2013.01); *F28D 2021/007* (2013.01); *F28D 2021/0071* (2013.01); *F28F 2260/02* (2013.01)

(58) Field of Classification Search
CPC . F28F 1/105; F28F 1/128; F25B 39/00; F28D 1/04
USPC ..... 165/152, 151, 148, 150, 153
See application file for complete search history.

(56) References Cited

U.S. PATENT DOCUMENTS 5,078,207 A * 1/1992 Asano ..... F28F 3/027 138/38
5,107,922 A * 4/1992 So ..... F28F 1/105 165/109.1
5,671,806 A 9/1997 Schmalzried
5,816,320 A * 10/1998 Arnold ..... F28D 1/0535 165/152
6,652,627 B1 11/2003 Tonkovich et al.
6,729,388 B2 5/2004 Emrich et al.
6,892,803 B2 5/2005 Memory et al.
6,969,505 B2 11/2005 Tonkovich et al.
7,059,397 B2 * 6/2006 Chatel ..... F28D 9/0068 165/166
7,255,845 B2 8/2007 Tonkovich et al.
7,294,734 B2 11/2007 Brophy et al.
8,418,752 B2 4/2013 Otahal et al.
8,424,592 B2 4/2013 Meshenky et al.
8,516,699 B2 8/2013 Grippe et al.
8,708,034 B2 * 4/2014 Saito ..... F24F 1/30 165/133
2003/0041640 A1 * 3/2003 Granetzke ..... B21D 13/04 72/186
2003/0106676 A1 6/2003 Bishop et al.
2004/0034111 A1 2/2004 Tonkovich et al.
2004/0094291 A1 * 5/2004 Memory ..... F28D 1/0478 165/140
2004/0220434 A1 11/2004 Brophy et al.
2005/0217837 A1 * 10/2005 Kudija, Jr. ..... F28D 7/0008 165/165
2006/0002848 A1 1/2006 Tonkovich et al.
2007/0267187 A1 * 11/2007 Wolk ..... F28F 1/128 165/181
2008/0031788 A1 2/2008 Brophy et al.
2008/0277095 A1 * 11/2008 Zhai ..... F25B 39/00 165/80.4
2010/0218930 A1 * 9/2010 Proeschel ..... B21D 53/04 165/185
2012/0031593 A1 * 2/2012 Uno ..... F28D 9/0043 165/148
2012/0291998 A1 11/2012 Anderson
2014/0224460 A1 * 8/2014 Means ..... F28D 1/05383 165/173

* cited by examiner

HEAT EXCHANGER COIL WITH OFFSET FINS

FIELD

Embodiments disclosed herein relate generally to a heat exchanger coil with offset fins. In particular, apparatuses, systems and methods are directed to heat exchangers that are made of microchannel tubes and that have offset fins of various geometries and density.

BACKGROUND

Offset strip fins have been used in brazed aluminum heat exchangers, such as may be implemented in the liquid air/gas industries and oil field type applications. Microchannel coils, such as may be implemented in units of refrigeration and/or heating ventilation, and air conditioning (HVAC) systems have used serpentine fins with louvers.

SUMMARY

Improvements may be made to heat exchanger coils, in particular heat exchanger coils made of microchannel tubes. For example, air side pressure drop can impact fan power or efficiency, limit face velocity across the coil, and limit coil depth, such as for example heat exchanger coils operating as an outdoor condenser coil, but may also be applicable to various dry (e.g. condenser) and wet (e.g. evaporator) coils. The use of offset fins in a microchannel heat exchanger coil can provide good heat transfer and also significantly reduce air side pressure drop when compared to, for example but not limited to traditional microchannel coils that do not have offset fins and/or may employ serpentine fins with louvers. The use of offset fins can be particularly suitable for microchannel heat exchanger coils such as at operating conditions including for example but not limited to lower face velocities, when the coil is employed for example in dry or wet heat transfer applications, and/or whether the coil is implemented as a condenser or evaporator. The use of offset fins in a microchannel heat exchanger coil can also enable the use of deeper coils and/or the use of higher fin density, for example when operating at a given fan power. The use of offset fins in a microchannel heat exchanger coil can thus result in higher system efficiency.

In an embodiment, the use of offset fins in a microchannel heat exchanger coil may be implemented in a heat pump design. In an embodiment, the use of offset fins in a microchannel heat exchanger coil may be implemented in an air coupled heat pump and/or air source heat pump.

In one embodiment, a heat exchanger coil includes multiple microchannel tubes connected to one or more headers. The headers in some embodiments may be one of a supply header, and one of a discharge header. The microchannel tubes are configured to have multiple openings through the tubes, and are configured to receive a process fluid, such as for example water, gas (e.g. air), refrigerant, lubricant, and the like, as well as mixtures thereof from one of the headers. The microchannel tubes can exit the process fluid after it flows through the microchannel tubes. The heat exchanger coil also includes a structure and arrangement of fins connected between the microchannel tubes. The structure and arrangement of fins includes offset fins.

By "offset" it is meant to include various structures and arrangements where leading edges of an upstream row of fins define a space(s) between the fins, and where another row of fins directly downstream of the upstream row of fins has one or more leading edges that are exposed to the space(s) between the fins of the upstream row. The offset structure and arrangement is to create interruptions through the exposure of leading edges of downstream fins to the openings between fins of an upstream row of fins. By "upstream" and "downstream" the meaning is relative to a fluid flow, such as for example the air flow direction through the heat exchanger coil.

In some embodiments, a downstream row is structured and arranged so that the leading edges of the fins face an opening through fins of an upstream row. In some embodiments, the structure and arrangement can have a staggered resemblance.

In some embodiments, the offset structure and arrangement is configured to provide a relatively short length through fins in the air flow direction, which can avoid the formation of boundary layers, while minimizing the impact of profile drag. The offset structure and arrangement can provide excellent heat transfer while lowering air pressure drop, for example when compared to fins without an offset structure and arrangement.

In some embodiments, the offset structure and arrangement can be repeating through a depth of the coil, which may be the air entry side to the air exiting side. In some embodiments, the offset structure can have varying geometries, such as but not limited to for example, the fin spacing, the offset spacing, the fin pitch, the fin length, the fin height, the material thickness, and/or the fin density, and the relative dimensions and ratios thereof.

In some embodiments, multiple geometries of offset structures and arrangements may be employed in the same coil, and can sometimes include geometries that are not offset geometries.

In some embodiments, the structure and arrangement of the fins can be coated with various materials, such as for example but not limited to an anti-corrosive material.

In some embodiments, the heat exchanger coils herein can be employed as a dry coil (e.g. condenser or air to fluid dry cooler) and/or a wet coil (e.g. evaporator) in various apparatuses and systems.

In some embodiments, the heat exchanger coils herein can be applied to various units of a refrigeration system and/or a HVAC system. One example is in an air handler unit.

In some embodiments, the heat exchanger coils herein can be applied in frost and/or defrost modes of application, where there are relatively less leading edges of the offset fins, creating fewer surface features for frost to grow compared to, for example, the much larger number of leading edges of conventional louvered or lanced serpentine fins traditionally applied to microchannel coils.

DRAWINGS

These and other features, aspects, and advantages of the heat exchanger coil with offset fins will become better understood when the following detailed description is read with reference to the accompanying drawing, wherein.

While the above-identified figures set forth particular embodiments of the heat exchanger coil with offset fins, other embodiments are also contemplated, as noted in the descriptions herein. In all cases, this disclosure presents illustrated embodiments of the heat exchanger coil with offset fins by way of representation but not limitation. Numerous other modifications and embodiments can be devised by those skilled in the art which fall within the scope and spirit of the principles of the heat exchanger coil with offset fins described and illustrated herein.

DETAILED DESCRIPTION

Embodiments disclosed herein relate generally to a heat exchanger coil with offset fins. In particular, apparatuses, systems and methods are directed to heat exchangers that are made of microchannel tubes and that have offset fins of various geometries and density.

For example, air side pressure drop can impact fan power or efficiency, limit face velocity across the coil, and limit coil depth, such as for example heat exchanger coils operating as an outdoor condenser coil. The use of offset fins in a microchannel heat exchanger coil can significantly reduce air side pressure drop when compared, for example but not limited to traditional microchannel coils that do not have offset fins and/or may employ serpentine fins with louvers. The use of offset fins in a microchannel heat exchanger coil can provide better condensing or evaporating pressure for a given fan power due to the reduction in pressure drop or ability to use less fan power for a desired capacity. The use of offset fins can also enable the use of deeper coils and/or the use of higher fin density, for example when operating at a given fan power. The use of offset fins in a microchannel heat exchanger coil can thus result in higher system efficiency.

In an embodiment, the use of offset fins can be particularly suitable for microchannel heat exchanger coils such as at operating conditions including for example but not limited to lower face velocities, when the coil is employed for example in dry or wet heat transfer applications, and/or whether the coil is implemented as a condenser or evaporator.

In an embodiment, the use of offset fins in a microchannel heat exchanger coil may be implemented in a heat pump design. In an embodiment, the use of offset fins in a microchannel heat exchanger coil may be implemented in an air coupled heat pump and/or air source heat pump.

Figure 1:
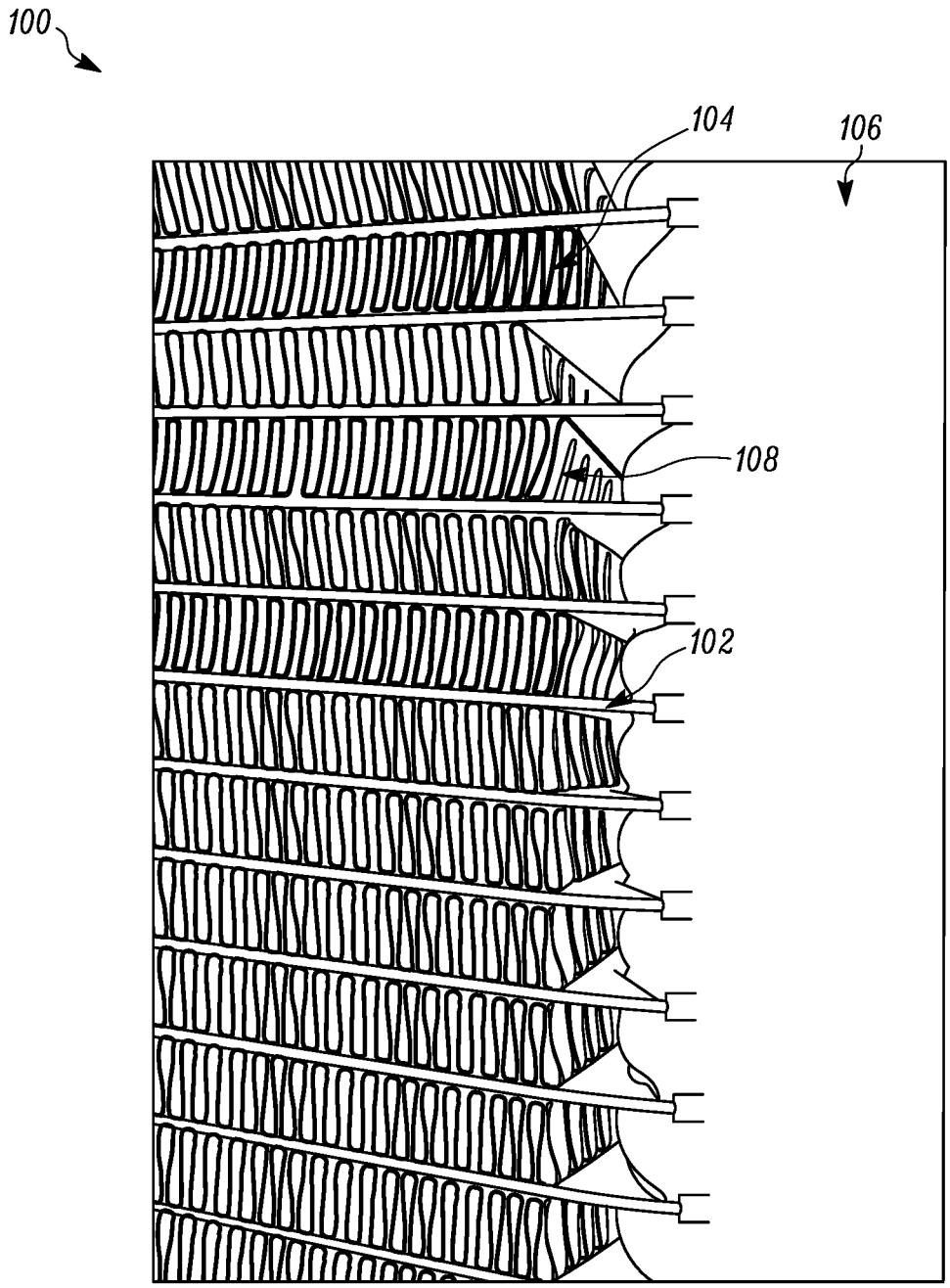
FIG. 1 is a partial view of a heat exchanger coil with microchannel tubes where the fins are structured and arranged to be offset in an air flow direction through the heat exchanger coil.

FIG. 1 is a partial view of a heat exchanger coil 100 with microchannel tubes 102 where the fins 104 are structured and arranged to be offset in an air flow direction through the heat exchanger coil.

In one embodiment, the heat exchanger coil 100 includes multiple microchannel tubes 102 connected to one or more headers 106. In the partial view shown, one header 106 can be either the supply header or the discharge header. It will be appreciated that both a supply and discharge header may be employed in a heat exchanger coil, e.g. coil 100, and that the partial view of FIG. 1 is for ease of description of the structure and arrangement of the fins 104 and their offset 108 configuration, which are further described below. For example another header may be disposed on the other end (not shown) of the microchannel tubes 102 and opposite of the header 106 as shown, and which is a typical structure of a microchannel coil. Thus, the headers (e.g. 106) in some embodiments may be one of a supply header, and one of a discharge header.

The microchannel tubes 102 are configured to have multiple openings (not shown) through the tubes 102, and are configured to receive a process fluid, such as for example water, gas (e.g. air), refrigerant, other heat transfer fluids such as but not limited to glycol or mixtures thereof, lubricant, and the like, as well as mixtures thereof from one of the headers (e.g. 106). The microchannel tubes 102 can exit the process fluid after it flows through the microchannel tubes 102. The heat exchanger coil 100 also includes a structure and arrangement of fins 104 connected between the microchannel tubes. The structure and arrangement of fins 104 includes offset fins 108.

By "offset" it is meant to include various structures and arrangements where leading edges of an upstream row of fins define a space(s) between the fins, and where another row directly downstream of the upstream row has one or more leading edges that are exposed to the space(s) between the fins of the upstream row. The offset structure and arrangement is to create interruptions through leading edges of downstream fins being exposed to openings between fins of an upstream row. By "upstream" and "downstream" the meaning is relative to a fluid flow, such as for example the air flow direction through the heat exchanger coil.

In some embodiments, a downstream row is structured and arranged so that the leading edges of the fins 104 face an opening through fins of an upstream row. It will be appreciated that one or more successive downstream rows may have such a structure and arrangement, and in some embodiments, each successive downstream row can have such as structure and arrangement. In some embodiments, the offset structure and arrangement 108 can have a staggered resemblance. In the offset structure and arrangement 108 of the fins 104 shown in FIG. 1, the leading edges for example of the upstream row of fins facing the entry of the coil have openings therebetween. Leading edges of the downstream row of fins (e.g. directly behind the upstream row) also have openings therebetween, where leading edges of the downstream row can be exposed to openings of the downstream row, and where openings of the downstream row are open to edges, e.g. trailing edges of an upstream row.

In some embodiments, the individual fins can have various geometries, such as for example where the individual fins are structured and arranged so their direction is parallel to the air flow through the heat exchanger (e.g. typically perpendicular to the heat exchanger face), although in some embodiments the individual fins may have a non-flat fin shape described by waves or other geometries (see e.g. FIG. 3 further described below).

In some embodiments, the offset structure and arrangement 108 is configured to provide a relatively short length through fins in the air flow direction, which can avoid the formation of boundary layers, while minimizing the impact of profile drag. See e.g. at 108 in FIG. 1 where the fin length (or lance length in the embodiment shown, see also FIG. 2) from the air flow direction of the upstream row terminates for example at a cutout where the downstream row begins. The offset structure and arrangement 108 can provide excellent heat transfer while lowering air pressure drop, for example when compared to fins without an offset structure and arrangement.

As shown in FIG. 1, the offset fins are arrayed in-line with the air flow direction, and can be structured and arranged to be staggered, so the fin length in the air flow direction is suitably short to avoid formation of large boundary layers, and have significantly less profile drag. Such a configuration can be advantageous over traditional louvered fins and/or serpentine fins with louvers, which result in excellent heat transfer and significantly lower air pressure drop.

Such a configuration can also result in the ability to use deeper coils and/or higher fin density with the same fan power, resulting in higher efficiency of the system, and can avoid increasing footprint of the heat exchanger coil except in the depth (air flow) direction.

In some embodiments, for example, by using offset fins in the microchannel tubed coil, additional depth may be used, where multiple coils may be stacked, e.g. by multiple microchannel rows, or can be made with increased depth by using wider microchannel tubes 102, e.g. going into the page of FIG. 1. It will be appreciated that tube spacing in the depth direction and across the air flow direction can vary as suitable and/or desired.

It will be appreciated that the offset fins 104, 108 can be constructed with minimal or no burrs, or with a generally smooth outer surface and/or edges, e.g. leading edges.

In some embodiments, such a structure and arrangement can be repeating through a depth of the coil, which may be taken from the air entry side to the air exiting side. See e.g. FIG. 2 further described below. In some embodiments, the offset structure can have varying geometries, such as but not limited to for example, the fin spacing, the offset spacing, the fin pitch, the fin length, the fin height, the material thickness, and/or the fin density, and the relative dimensions and ratios thereof.

For example, in some embodiments, fin pitch and fin spacing can vary depending on the intended design contemplated and/or to be implemented. Width of the fins (e.g. similar to lance length as shown in the embodiment and in FIG. 2) in the air flow direction and the amount of offset can be varied depending on the depth of the overall fin structure in the air flow direction. In certain circumstances, more heat transfer in front of the coil, e.g. relative to the air flow direction on the entry side into the coil, it may be desirable in some embodiment to construct and arrange the width of the fins in the air flow direction to be longer toward the front of the coil on the air entry side, and perhaps to have relatively shorter fins in the back of the coil on the exiting side. It will be appreciated that in some embodiments, the fins may be shorter at or relatively toward the entry side and then longer at or relatively toward the exit side. It will also be appreciated that varying the fin geometry in the air flow direction may be useful in wet coils and/or coils that may be susceptible to frost, which is further described below.

It will be appreciated that the offset configuration of the fins faces the direction of the air flow, and in some cases can have more dense fins, e.g. smaller pitch between the fins.

In some embodiments, multiple geometries of offset structures and arrangements may be employed in the same coil, and can sometimes include geometries that are not offset. See e.g. FIG. 3 further described below.

In some embodiments, the structure and arrangement of the fins 104, 108 can be coated with various materials, such as for example but not limited to an anti-corrosive material. It will be appreciated that other treatment coating may be employed, which may be suitable and/or needed for the particular implementation of the heat exchanger coil 100. In general, the structure and arrangement of the offset fins 104, 108 in some circumstances can have a geometry that can allow for coating, where there would be less performance penalties on geometries of offset coils, compared to for example but not limited to louvered fin coils, which have smaller scaled geometries.

Generally, the offset fins 104, 108 include a structure and arrangement to receive flow through a surface of the fins that have interruptions, where the flow is through the surface and then through the interruptions, which can be repeated and/or have some pattern, such as various geometries, densities, and the like. The offset fins 104, 108 herein are structured and arranged to allow relatively straight flow over relatively flat surfaces rather than for example around louvers of a serpentine arrangement, which usually has bends and more profile drag. Offset fins can be one example of a fin structure and arrangement that receives flow through a surface of the fins that have interruptions, where leading edges from the offset interrupt boundary layer(s) in fluid flow to increase heat transfer and/or efficiency. In some circumstances, the fin structure and arrangement herein can re-start boundary layer(s) to increase heat transfer and/or efficiency. In some cases, the fin structure and arrangement can induce some turbulence in the air flow which can aid in heat transfer, but while not significantly impacting pressure drop penalty.

Figure 2:
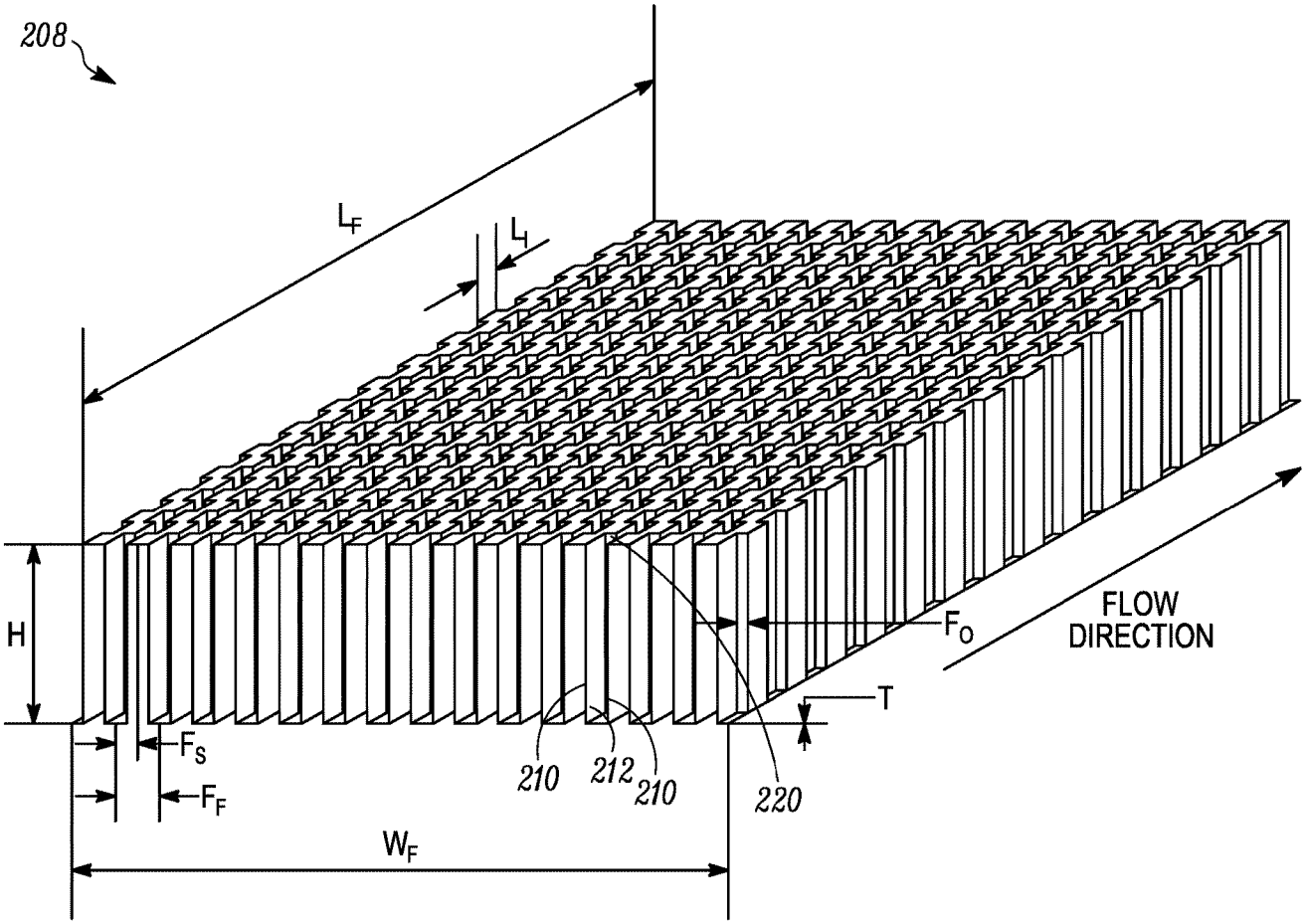
FIG. 2 is an example geometry of offset fins that may be applied to a heat exchanger with microchannel tubes.

FIG. 2 is one embodiment of an example geometry of offset fins 208 that may be applied to a heat exchanger with microchannel tubes. The offset fins 208 are similar to the structure and arrangement shown in FIG. 1, which resemble lanced fins in an offset configuration. In some embodiments, the offset structure can have varying geometries, such as but not limited to for example, the fin spacing, the offset spacing, the fin pitch, the fin length, the fin height, the material thickness, and/or the fin density, and the relative dimensions and ratios thereof.

FIG. 2 shows the offset fins to include a fin spacing $F_s$, fin pitch $F_F$, fin height H, material thickness T, fin (e.g. lance) length $L_l$, as well as in the flow direction dimensions defined as flow length $L_f$, flow width $W_f$, and the flow direction shown by the arrow. The offset fins can also have a fin offset $F_o$.

As shown in FIG. 2, in some embodiments, the offset structure and arrangement 208 can be repeating and/or patterned through a depth of the coil, which may be taken from the air entry side to the air exiting side along the air flow direction.

With regard to the offset structure, FIG. 2 shows an example of the offset structure where a downstream row is structured and arranged so that the leading edges of the fins 220 downstream face an opening 212 through and between fins 210 of an upstream row. In some embodiments, the offset structure and arrangement 208 can have a staggered resemblance. In the offset structure and arrangement 208 shown in FIG. 2, the leading edges 210 for example of the upstream row of fins faces the entry of the coil have an opening 212 therebetween. Leading edges 220 of the downstream row of fins (e.g. directly behind the upstream row) also have openings therebetween, where the leading edges 220 of the downstream row can be exposed to openings of the downstream row, and where openings of the downstream row are open to edges, e.g. trailing edges of an upstream row.

In some embodiments, the offset structure and arrangement 208 can have a fin spacing $F_s$ that satisfies a dimension of at or about 4 fins per inch to at or about 40 fins per inch. In some embodiments, the fin spacing $F_s$ can be at or about 16 fins per inch to at or about 20 fins per inch, and in some cases at or about 18 fins per inch. In some embodiments, the fin spacing $F_s$ can be at or about 15 fins per inch to at or about 23 fins per inch. In some embodiments, the fin spacing $F_s$ can be at or about 4 fins per inch to at or about 8 fins per inch.

In an embodiment, relatively smaller numbers of fins and larger fin spacing can be useful in wet applications, e.g. wet evaporator applications.

In some embodiments, the offset structure and arrangement 208 can have a fin pitch $F_F$ that satisfies a dimension across two fins as shown in FIG. 2.

In some embodiments, the offset structure and arrangement 208 can have a fin height $F_h$ that satisfies a dimension of at or about 0.250 inches to at or about 0.750 inches. In some embodiments, the fin height $F_h$ can be at or about 0.297 inches to at or about 0.301 inches.

In some embodiments, the offset structure and arrangement 208 can have a material thickness T that satisfies a dimension of at or about 0.002 inches to 0.020 inches. In some embodiments, the material thickness T can be at or about 0.004 inches.

In some embodiments, the offset structure and arrangement 208 can have a fin length $L_l$ that satisfies a dimension of at or about 0.031 inches to at or about 1.000 inches. In some embodiments, the fin length $L_l$ can be at or about 0.125 inches.

It will be appreciated that the fin geometry can be easily varied through the offset coil, for example, such that the fins at the front and the fins at the back have different patterns, possibly length of the lance, e.g. labeled as $L_l$. However, it is to be appreciated that this applies to more than just the length of the lance. For example, other shapes and geometries could be made, such as for example, similar to an impingement type liquid vapor separator, which can allow water management capability, e.g. by forcing drops to coalesce so that they drain better, such as off an evaporator.

In some embodiments, the offset structure and arrangement 208 can have a flow length $L_f$ that satisfies a dimension of at or about 0.375 inches to at or about 20.0 inches.

In some embodiments, the offset structure and arrangement 208 can have a flow width $W_f$ that satisfies shipping dimensions. In some embodiments, the flow width $W_f$ can be at or about 23 inches to at or about 199 inches or at or about 200 inches.

In some embodiments, the offset structure and arrangement 208 as shown in FIG. 2 can have a fin offset $F_o$ that satisfies a dimension of at or about 0.125 inches to at or about 0.0125 inches.

In some embodiments, the material of the fins can be but is not limited to aluminum, copper, brass, stainless steel, steel Inconel and/or suitable alloys, and/or titanium.

It will be appreciated that the dimensions and materials above can apply to any of the offset fin structures and arrangements herein and any of the heat exchanger microchannel coils herein. It will also be appreciated that such dimensions can vary in any given coil, and are not limited to the stated dimensions herein, but can be varied for example so as to optimize the coil for the application intended.

Figure 3:
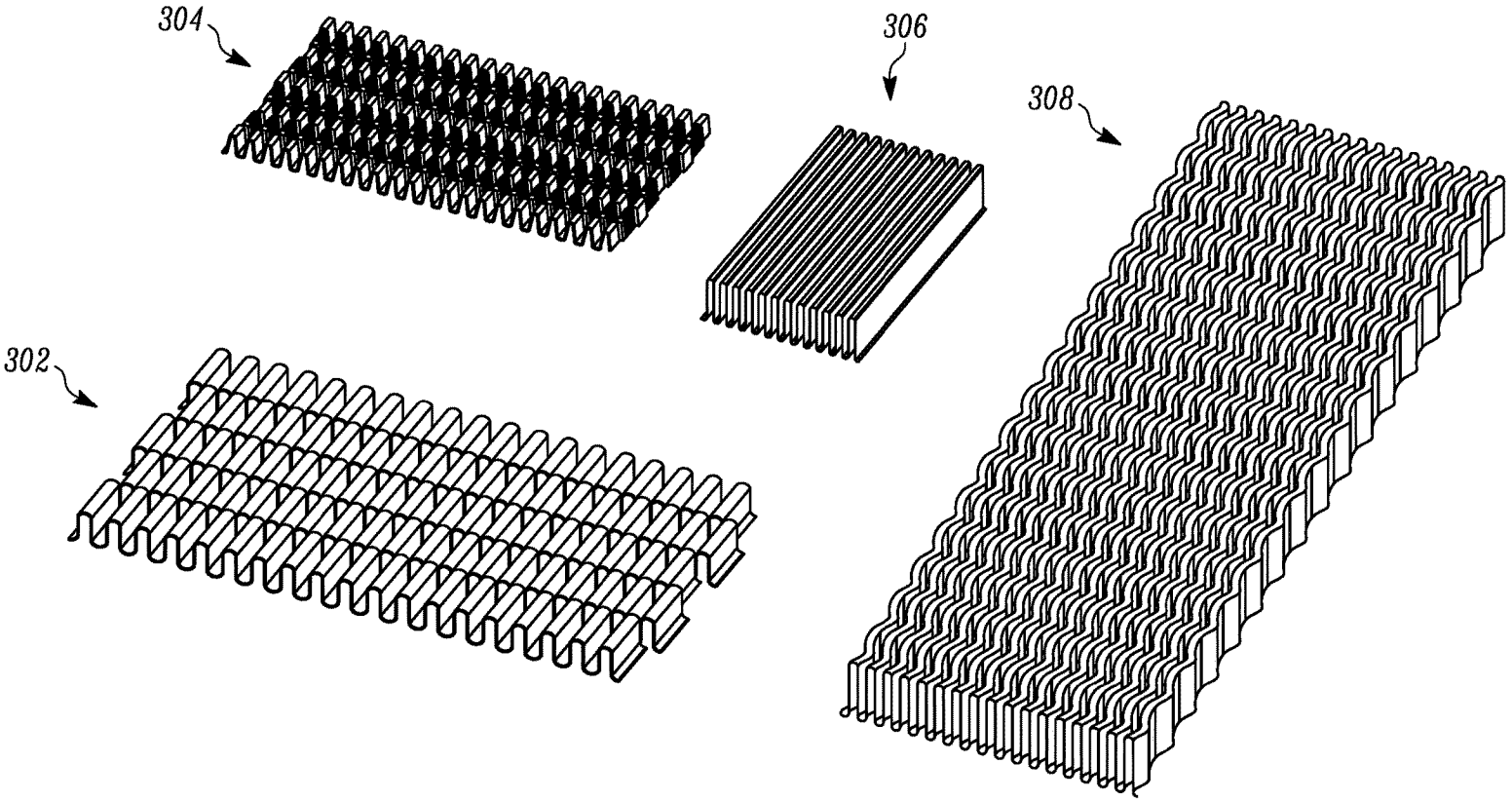
FIG. 3 shows additional examples of geometries that may be used as fins in a heat exchanger with microchannel tubes.

FIG. 3 shows additional examples of geometries that may be used as fins in a heat exchanger with microchannel tubes.

In some embodiments, multiple geometries of offset structures and arrangements may be employed in the same coil, and can sometimes include geometries that are not offset. FIG. 3 shows various other geometries that may be employed in the heat exchanger coils with microchannel tubes herein. It will be appreciated that use of multiple geometries may be combined in the same fin arrangement for a given coil may be employed. It will be appreciated that offset fins can have geometries and offsets that vary within the same coil, as well as include geometries that are not offset. FIG. 3 shows for example an offset fin structure and arrangement 302 similar to FIGS. 1 and 2 (e.g. lanced offset), as well as louvered fins 304, straight fins 306, and wavy fins 308. Wavy fins such as shown in 308 of FIG. 3 may be particularly useful in combination with the offset structures and arrangements herein in that they may also provide a side to side flow which may facilitate some turbulent flow.

In some embodiments, the offset fins can be brazed to multi-port extrusions or in some embodiments can be folded multiport flat tubes in a controlled atmosphere brazing (CAB) of aluminum in a same manner as traditional microchannel coils. In some embodiments, the microchannel tubes are made by using extruded aluminum, and where tube spacing can vary and desired and/or suitable. In some embodiments, the offset fins are manufactured as offset strip fins that can be suitably applied to the microchannel tubes. As described, various geometries for the offset fins can include for example but not limited to staggering the width of the strips, and may include various slits in the fins to achieve the desired offset configuration.

Computational fluid dynamics (CFD) studies and wind tunnel testing of microchannel coils having offset fins have shown significantly lower air side pressure drop. The significance is shown relative to traditional microchannel heat exchanger coils having serpentine fins with louvers. The improvement in air side pressure drop (i.e. reduction of pressure drop) is shown to be, for example, at or about 30% to at or about 50%.

The use of offset strip fins can be particularly suitable for microchannel heat exchanger coils such as at lower face velocities such as may be employed in dry (or wet) heat transfer (e.g. at or about 200 ft/min to at or about 400 ft/min) or in wet heat transfer applications, whether implemented as a condenser or evaporator.

In an embodiment, the use of offset fins in a microchannel heat exchanger coil may be implemented in a heat pump design. In an embodiment, the use of offset fins in a microchannel heat exchanger coil may be implemented in an air coupled heat pump and/or air source heat pump.

Figure 4:
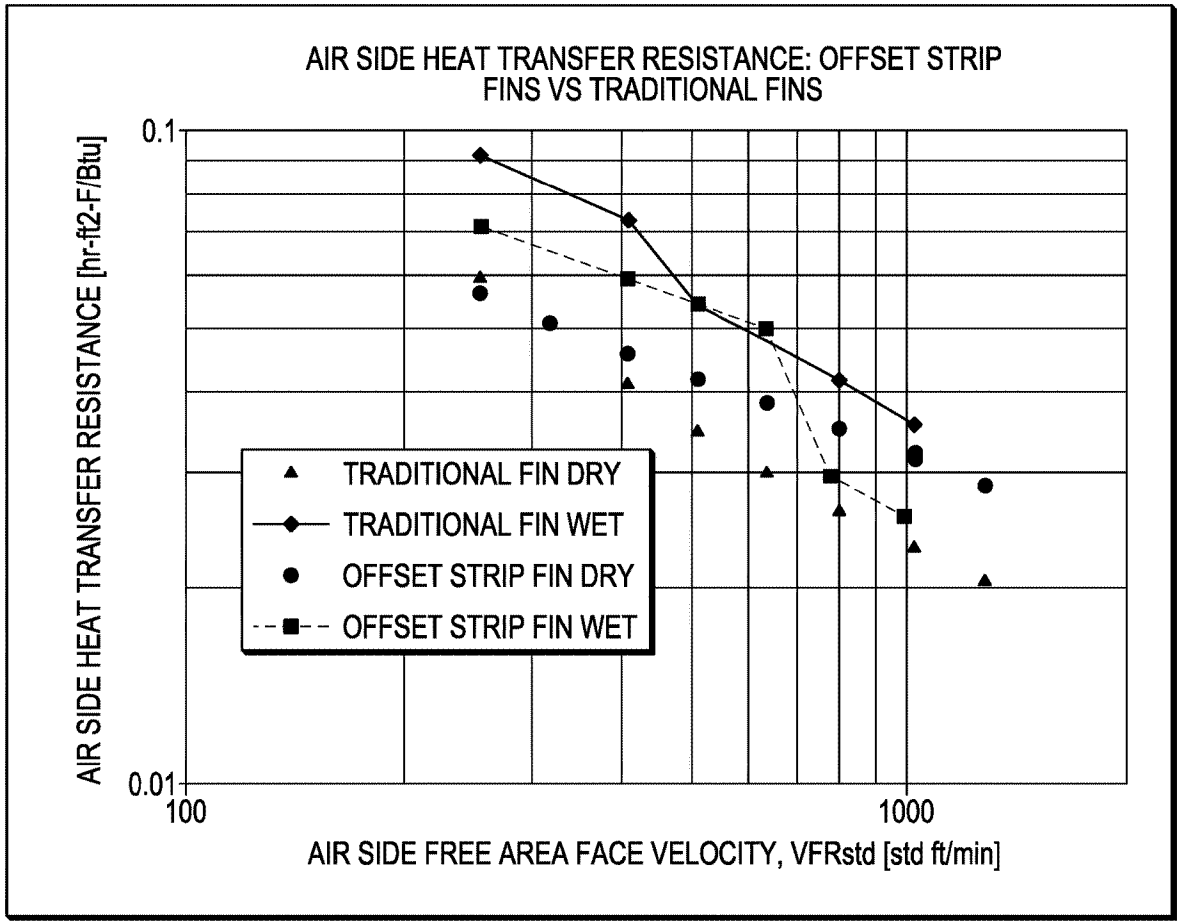
FIG. 4 shows heat transfer results for a microchannel heat exchanger coil with offset fins compared to microchannel coils that do not have offset fins.
Figure 5:
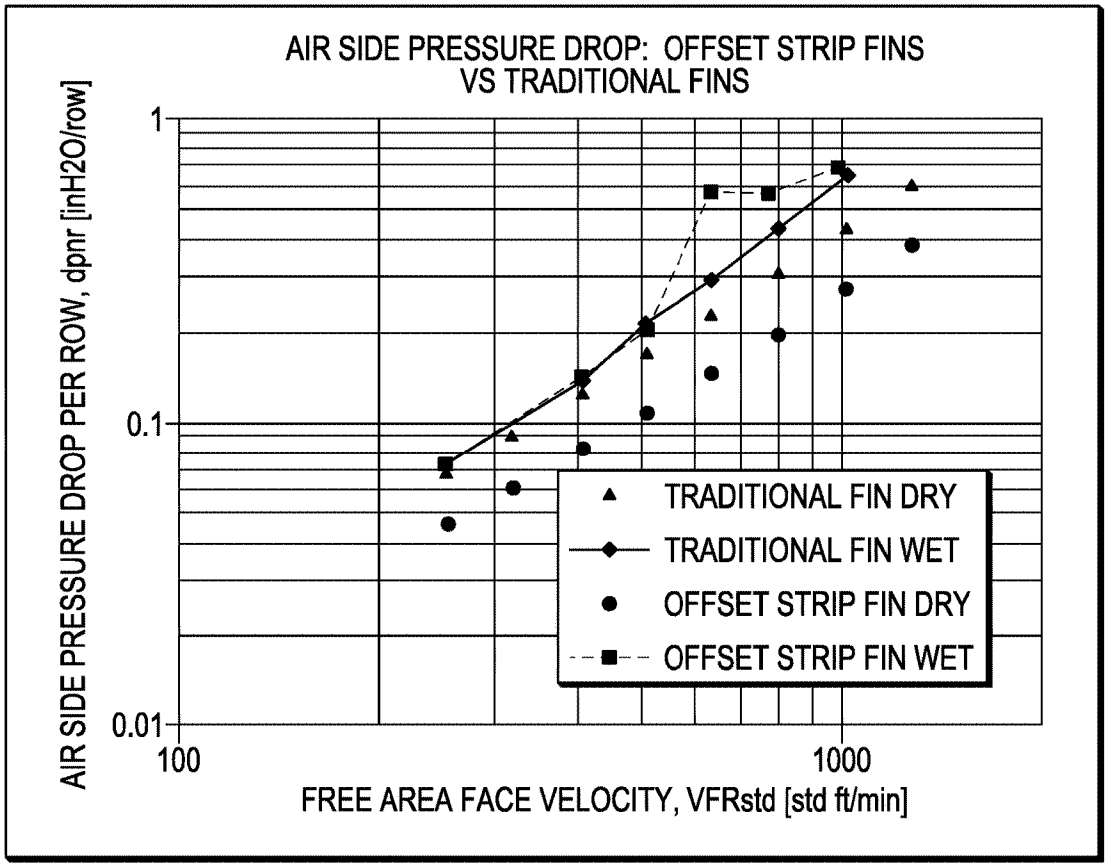
FIG. 5 shows air pressure drop results for a microchannel heat exchanger coil with offset fins compared to microchannel coils that do not have offset fins.

FIGS. 4 and 5 show results for a microchannel heat exchanger coil with offset fins compared to microchannel coils that do not have offset fins. The microchannel heat exchanger coil tested is similar to the coil shown in FIG. 1. In particular, FIG. 4 shows heat transfer results for a microchannel heat exchanger coil with offset fins compared to microchannel coils that do not have offset fins. In particular, FIG. 5 shows air pressure drop results for a microchannel heat exchanger coil with offset fins compared to microchannel coils that do not have offset fins.

FIG. 4 shows results on a tested coil showing significantly better heat transfer in wet coils, for example at low Reynolds number (Re) and showing comparable heat transfer in dry coils, for example at low Re. FIG. 4 shows plots of wet and dry fin coils (e.g. serpentine, louvered fins) against dry and wet fin coils employing offset strip fins in the coil. The plots in FIG. 4 shows air side heat transfer resistance (hr-ft$^2$-F/Btu) vs. air side free area face velocity (frontal velocity $V_{fr}$) ft/min.

FIG. 5 shows results on a tested coil showing dry air pressure drop. FIG. 5 shows plots of wet and dry fin coils (e.g. serpentine, louvered fins) against dry and wet fin coils employing offset strip fins in the coil. The plots in FIG. 5 show air side pressure drop per row (dpnr) by inches water column per (inH2O/row) vs. air side free area face velocity (frontal velocity $V_{fr}$) ft/min. At various velocities Va, such as for example 255, 318, 407, 509, 636, 802, 1016, and 1271, the percentage improvement in lower air pressure drop was observed at 70%, 68%, 66%, 65%, 64%, 63%, 64%, and 64%, respectively, as compared to traditional coils without the offset strip fins. As shown, lower air pressure drop for dry offset structured coils was observed relative to a traditional coil, e.g. traditional finned coils, and wet offset structured coils has similar air pressure drop relative to the traditional coil at operating range, e.g. relatively lower face velocities. Wet offset coils showed better heat transfer at relatively lower Reynolds numbers.

It will be appreciated that in some embodiments, the heat exchanger coils herein can be employed as a dry coil (e.g. condenser) and/or a wet coil (e.g. evaporator) in various apparatuses and systems.

In an embodiment, the use of offset fins in a microchannel heat exchanger coil may be implemented in a heat pump design. In an embodiment, the use of offset fins in a microchannel heat exchanger coil may be implemented in an air coupled heat pump and/or air source heat pump.

It will also be appreciated that in some embodiments, the heat exchanger coils herein can be applied to various units of a refrigeration system and/or a HVAC system. One example is in an air handler unit and/or various units used in comfort cooling applications.

In other embodiments, the heat exchanger coils herein may be implemented in radiators, e.g. liquid to air type radiators. It will also be appreciated that in some embodiments the heat exchanger may be implemented into an air cooled power generation condenser, which in some cases may be used for large air cooled steam condensers.

In some embodiments, the heat exchanger coils herein can be applied in a frost and/or defrost modes of application, where there are relatively less leading edges of the fins which have less surface in the air flow direction for frost to build up. In an embodiment, such fins can also have greater fin spacing (e.g. $F_s$). The offset configurations herein can be advantageous over, for example, louvered fin configurations. Frosting/defrosting conditions, for example using microchannel heat exchanger coil may be present in certain heat pipe applications. The heat exchanger coils herein with the offset structure and configuration can have less leading edges relative to the air flow direction, thereby providing in some embodiments, about 4 to about 10 slots relative to 20 or more slots used in traditional louvered fin configuration. With reference to FIG. 1 for example, a slot is created, e.g. at about 108, where going into the page or depth direction of the coil, there are openings between fin rows (see e.g. opening behind first row), whereas in louvered fins each louver creates a slot or opening, where such louvered coils have more openings in the depth direction (air flow direction) of the coil relative to an offset structured coil. Such a change provides a reduction in some cases by a factor of about 2 to 5, which provides less surface being susceptible for frost build up, since frost may tend to form at such edge features. Offset fin structures and arrangements herein can also provide the advantage of draining better.

The offset structures and arrangements herein can be particularly suitable and provide an improvement for units operating at relatively lower face velocities, where microchannel heat exchanger coils with relatively shallow or moderate depth are employed.

Aspects

Aspects—any of aspects 1 to 12 may be combined with any of aspects 13 to 18, aspect 13 may be combined with any of aspects 14 to 18, aspect 14 may be combined with any of aspects 15 to 18, aspect 16 may be combined with either of aspect 17 or aspect 18, and aspect 17 may be combined with aspect 18.

1. A heat exchanger coil comprising:
   multiple microchannel tubes connected to one or more headers,
   the headers comprise at least of one of a supply header and one of a discharge header,
   the microchannel tubes are configured to have multiple openings through the tubes, and are configured to receive a process fluid from the discharge header and to exit the process fluid after it flows through the microchannel tubes,
   a structure and arrangement of fins connected between the microchannel tubes, the structure and arrangement of fins includes offset fins.

2. The heat exchanger coil of aspect 1, wherein the offset fins comprise leading edges of an upstream row of fins that define one or more spaces between the fins, and where a row of fins directly downstream of the upstream row of fins has one or more leading edges that are exposed to the one or more spaces between the fins of the upstream row.

3. The heat exchanger coil of aspect 1 or 2, wherein the offset fins are configured to create interruptions through leading edges of downstream fins being exposed to openings between fins of an upstream row.

4. The heat exchanger coil of any of aspects 1 to 3, wherein the offset fins comprise a downstream row of fins being structured and arranged so that leading edges of the downstream row of fins face an opening through fins of an upstream row.

5. The heat exchanger coil of any of aspects 1 to 4, wherein the offset fins are staggered from row to row relative to an air flow direction through the coil.

6. The heat exchanger coil of any of aspects 1 to 5, wherein the offset fins are configured to provide a relatively short length through fins in the air flow direction, where the fin length is suitable to avoid the formation of boundary layers, and while minimizing the impact of profile drag.

7. The heat exchanger coil of any of aspects 1 to 6, wherein the offset fins can be a repeating pattern through a depth of the coil in the air flow direction through the coil.

8. The heat exchanger coil of any of aspects 1 to 7, wherein the offset fins includes a geometry defined by one or more of fin spacing, offset spacing, fin pitch, fin length, fin height, material thickness, and/or fin density, and including the relative dimensions and ratios thereof.

9. The heat exchanger coil of any of aspects 1 to 8, wherein the offset fins include multiple geometries of offset structures and arrangements 10. The heat exchanger coil of any of aspects 1 to 9, wherein the structure and arrangement of fins includes geometries that are not offset.

11. The heat exchanger coil of any of aspects 1 to 10, wherein the structure and arrangement of the fins are coated.

12. The heat exchanger coil of any of aspects 1 to 11, wherein the structure and arrangement of fins is coated with an anti-corrosive material.

13. An evaporator operating as a wet coil, comprising the heat exchanger coil of any of aspects 1 to 12.

14. A condenser coil operating as a dry coil, comprising the heat exchanger coil of any of aspects 1 to 12.

15. An air handling unit, comprising the heat exchanger coil of any of aspects 1 to 14.

16. A heat exchanger operating in ambient conditions with susceptibility to frost, comprising the heat exchanger coil of any of aspects 1 to 15, and where the heat exchanger coil includes fins with a structure and arrangement of leading edges that reduce the susceptibility to frost build up.

17. A refrigeration unit or system, comprising the heat exchanger coil of any one or more of aspects 1 to 16.

18. A HVAC unit or system, comprising the heat exchanger coil of any one or more of aspects 1 to 16.

19. A method of air flow comprises directing air into and through the heat exchanger coil of any one or more of aspects 1 to 16.

The invention claimed is:

1. A heat exchanger coil, comprising:

multiple microchannel tubes connected to one or more headers, the one or more headers comprising at least of one of a supply header or a discharge header, the microchannel tubes are configured to have multiple openings through the tubes, and are configured to receive or provide a process fluid from or to the one or more headers and to exit the process fluid after it flows through the microchannel tubes, a structure and arrangement of fins connected between the microchannel tubes, the structure and arrangement of fins includes offset fins, the offset fins being between the microchannel tubes, the offset fins being constructed with a generally smooth outer surface, wherein the offset fins have a geometry including a fin density, and wherein the fin density is varied along a flow length of the offset fins, the flow length being a total length in an air flow direction of the offset fins.

2. The heat exchanger coil of claim 1, wherein the offset fins comprise leading edges of an upstream row of fins that define one or more spaces between the fins, and where a row of fins directly downstream of the upstream row of fins has one or more leading edges that are exposed to the one or more spaces between the fins of the upstream row.

3. The heat exchanger coil of claim 1, wherein the offset fins are configured to create interruptions through the leading edges of downstream fins being exposed to openings between fins of an upstream row.

4. The heat exchanger coil of claim 1, wherein the offset fins comprise a downstream row of fins being structured and arranged so that leading edges of the downstream row of fins face an opening through fins of an upstream row.

5. The heat exchanger coil of claim 1, wherein the offset fins are staggered from row to row relative to the air flow direction through the coil.

6. The heat exchanger coil of claim 1, wherein the offset fins are configured to provide the fin length through fins in the air flow direction, where the fin length is suitable to avoid the formation of boundary layers, and to minimize the impact of profile drag.

7. The heat exchanger coil of claim 1, wherein the offset fins include a repeating pattern through a depth of the coil in the air flow direction through the coil.

8. The heat exchanger coil of claim 1, wherein the offset fins have a geometry that further includes one or more of fin spacing, offset spacing, fin pitch, fin length, fin height, and/or material thickness.

9. The heat exchanger coil of claim 1, wherein the offset fins include multiple geometries of offset structures and arrangements.

10. The heat exchanger coil of claim 1, wherein the structure and arrangement of fins includes geometries that are not offset.

11. The heat exchanger coil of claim 1, wherein the structure and arrangement of fins is coated.

12. The heat exchanger coil of claim 1, wherein the structure and arrangement of fins is coated with an anti-corrosive material.

13. An evaporator operating as a wet coil, comprising the heat exchanger coil of claim 1.

14. A condenser coil operating as a dry coil, comprising the heat exchanger coil of claim 1.

15. An air handling unit, comprising the heat exchanger coil of claim 1.

16. A heat exchanger operating in ambient conditions with susceptibility to frost, comprising the heat exchanger coil of claim 1, and wherein the heat exchanger coil includes fins with a structure and arrangement of leading edges that reduce the susceptibility to frost build up.

17. A refrigeration unit or system, comprising the heat exchanger coil of claim 1.

18. The refrigeration unit or system of claim 17, wherein the refrigeration unit or system is an HVAC unit or system.

19. The heat exchanger coil of claim 1, wherein the microchannel tubes have outer surfaces, the offset fins being between the outer surfaces of the microchannel tubes.

20. A heat exchanger coil, comprising:

multiple microchannel tubes connected to one or more headers, the one or more headers comprising at least of one of a supply header or a discharge header, the microchannel tubes are configured to have multiple openings through the tubes, and are configured to receive or provide a process fluid from or to the one or more headers and to exit the process fluid after it flows through the microchannel tubes, a first structure and arrangement of fins connected between a first and second of the multiple microchannel tubes, the first structure and arrangement of fins includes offset fins, the offset fins being between the first and second of the multiple microchannel tubes, the offset fins being constructed with a generally smooth outer surface, and a second structure and arrangement of fins connected between a third and fourth of the multiple microchannel tubes, the second structure and arrangement of fins includes fins that are not offset.

* * * * *